US005896901A

United States Patent [19]

Lacroix

[11] Patent Number: 5,896,901

[45] Date of Patent: Apr. 27, 1999

[54] DEBARKING DRUM

[75] Inventor: Maurice Lacroix, Windsor, Canada

[73] Assignee: Les Installations Soudins (1990) Inc., Quebec, Canada

[21] Appl. No.: 09/041,133

[22] Filed: Mar. 12, 1998

[51] Int. Cl.[6] ..... B27C 1/00

[52] U.S. Cl. ..... 144/208.9; 144/208.1; 144/241; 144/341; 241/178; 241/183; 241/278.2

[58] Field of Search ..... 241/178, 183, 241/278.1, 278.2; 144/208.1, 208.9, 241, 340, 341

[56] References Cited

U.S. PATENT DOCUMENTS

| | | | |
|---|---|---|---|
| 1,946,440 | 2/1934 | Herrmann . | |
| 3,783,918 | 1/1974 | Simpson et al. | 144/208.9 |
| 3,948,300 | 4/1976 | Young | 144/208.9 |
| 3,955,608 | 5/1976 | Smiltneek | 144/208.9 |
| 5,673,865 | 10/1997 | Stroulger | 144/208.9 |

FOREIGN PATENT DOCUMENTS

| | | |
|---|---|---|
| 427924 | 6/1945 | Canada . |
| 609404 | 11/1960 | Canada . |
| 733793 | 5/1966 | Canada . |
| 745445 | 11/1966 | Canada . |
| 994646 | 8/1976 | Canada . |
| 1225309 | 8/1987 | Canada . |

*Primary Examiner*—W. Donald Bray
*Attorney, Agent, or Firm*—Birch, Stewart, Kolasch & Birch, LLP

[57] ABSTRACT

A rotatable debarking drum for removing the bark from logs comprises a cylindrical member and a plurality of axially extending rows of debarking tools circumferentially distributed on an inner circumference of the cylindrical member. Each row of debarking tools includes a plurality of axially spaced-apart arcuate ribs extending transversally relative to the cylindrical member axis. The discontinuous axially extending rows of debarking tools arrangement contributes to increase the efficiency of the overall debarking operation.

10 Claims, 4 Drawing Sheets

DEBARKING DRUM

BACKGROUND OF INVENTION

1. Field of invention

The present invention relates to a debarking drum and, more particularly, to debarking drums of the type having longitudinally spaced-apart debarking ribs mounted to an inner surface thereof for removing bark from logs.

2. Description of the Prior Art

As is well known, conventional debarking drums generally consist of an elongated rotatable cylindrical drum having an open inlet end for receiving the logs to be debarked and an open outlet end for discharging the debarked logs. Typically, the cylindrical drum is provided with barking tools on an inner circumference thereof for applying hammer-like impact blows to logs in the drum, while the same is being rotated.

For instance, U.S. Pat. No. 3,948,300 issued on Apr. 6, 1976 and Canadian Patent No. 994,646 issued on Aug. 10, 1976 to Young disclose a rotatable cylindrical drum having on an inner circumference thereof a plurality of staggered protrusions arcuatetly contoured on all working sides. The protrusions are mounted to the drum by axially spaced-apart annular mounting rings. The protrusions are disposed in staggered spaced relationship to provide random impacts to logs.

Canadian Patent No. 745,445 issued on Nov. 1, 1966 to Delcellier discloses a debarking drum having a plurality of longitudinally extending corrugations on the inner periphery thereof for debarking the logs.

Canadian Patent No. 609,404 issued on Nov. 29, 1960 to Henson discloses a debarking drum having a plurality of longitudinal members of circular cross-section which are mounted to a plurality of axially spaced-apart annular plates so as to form a cylindrical framework. In operation, the logs tumble against each other and the longitudinal members so that the bark thereof knocked off.

Although the debarking drums described in the above mentioned patents are effective for removing the bark from logs, it has been found that a rearrangement of the barking tools would be beneficial to the debarking operations.

SUMMARY OF THE INVENTION

It is therefore an aim of the present invention to provide a debarking drum with improved tools which are effective for debarking tree sections.

It is also an aim of the present invention to provide debarking tools which may be retrofitted to existing debarking drums.

Therefore, in accordance with the present invention, there is provided a rotatable debarking drum for removing the bark from logs comprising a generally cylindrical drum means having a longitudinal axis, and a plurality of axially extending rows of debarking means distributed on an inner circumference of the cylindrical drum means, each row of debarking means including a plurality of arcuately spaced-apart rib means extending transversally relative to the longitudinal axis of the cylindrical drum means.

In a further construction in accordance with the present invention, the distance between two consecutive rib means of a same row is of about ten inches.

In a further construction in accordance with the present invention, each rib means includes a substantially flat arcuate member.

In a further construction in accordance with the present invention, each arcuate member has bevelled bottom edges.

In a further construction in accordance with the present invention, a plurality of longitudinally extending arcuate stave means are secured at spaced-apart locations to the inner circumference of the drum means. A plurality of longitudinally spaced-apart rib means are mounted on each arcuate stave means.

In a further construction in accordance with the present invention, each rib means includes a substantially U-shaped member which is configured to fit on an outer circumference of one of the stave means.

In a further construction in accordance with the present invention, there is provided a rotatable debarking drum for removing bark from logs comprising a plurality of longitudinally spaced-apart debarking means placed in axially extending rows on an inner circumference of the debarking drum.

In a further construction in accordance with the present invention, each debarking means has an arcuate working surface and extends transversally relative to a longitudinal axis of the debarking drum.

BRIEF DESCRIPTION OF THE DRAWINGS

Having thus generally described the nature of the present invention, reference will now be made to the accompanying drawings, showing by way of illustration a preferred embodiment thereof in which.

DESCRIPTION OF THE PREFERRED EMBODIMENTS

Figure 1:
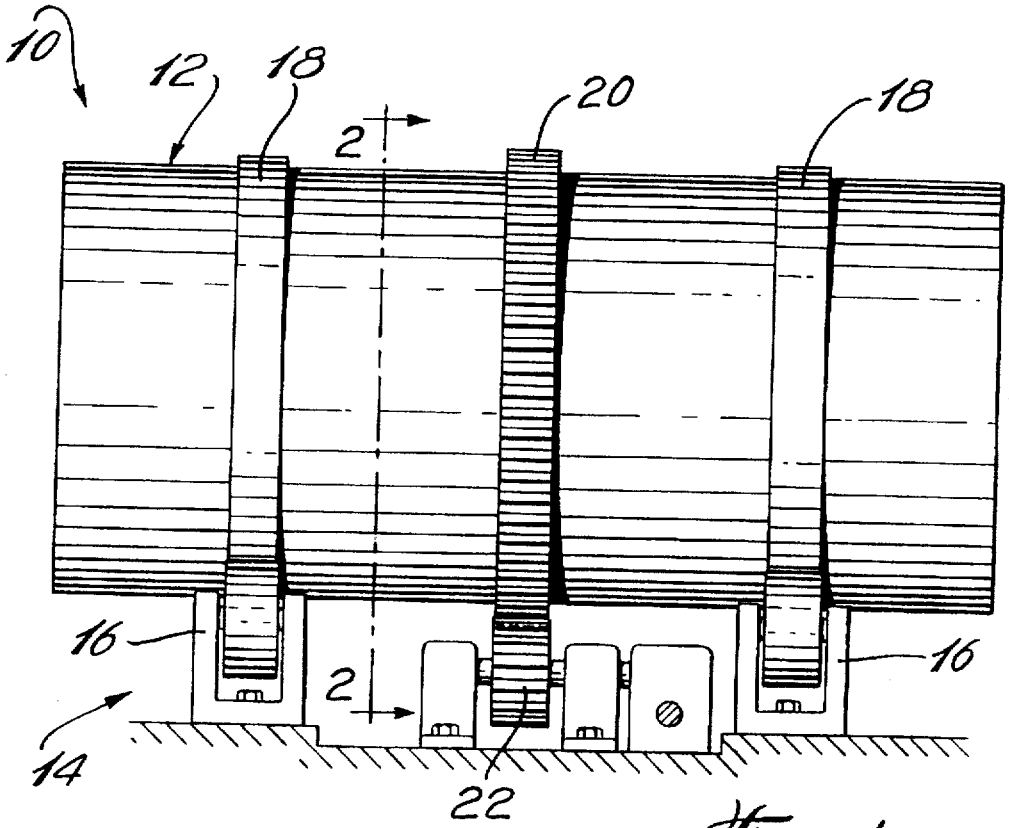
FIG. 1 is a side elevational view of a debarking drum in accordance with the present invention.

Now referring to the drawings, and more particularly to FIG. 1, a debarking drum embodying the elements of the present invention and generally designated by numeral 10 will be described.

More particularly, the debarking drum 10 includes an elongated hollow cylindrical member 12 mounted for rotation on a support 14 which comprises two pairs of supporting trunnion rollers 16 rotatably engaging two axially spaced-apart annular members 18 mounted on an outer circumference of the cylindrical member 12. The cylindrical member 12 carries an annular circumferential toothed gear 20 meshing with a driving gear 22 coupled to a conventional motor and speed reducer assembly for rotatably driving the cylindrical member 12 in the counter-clockwise direction, as schematically depicted by arrow 23 in FIG. 2. As will be understood, such illustrated support and driving arrangements have been shown only for the purposes of illustration, and thus the cylindrical member 12 may be otherwise suitably rotatably mounted and driven.

Figure 2:
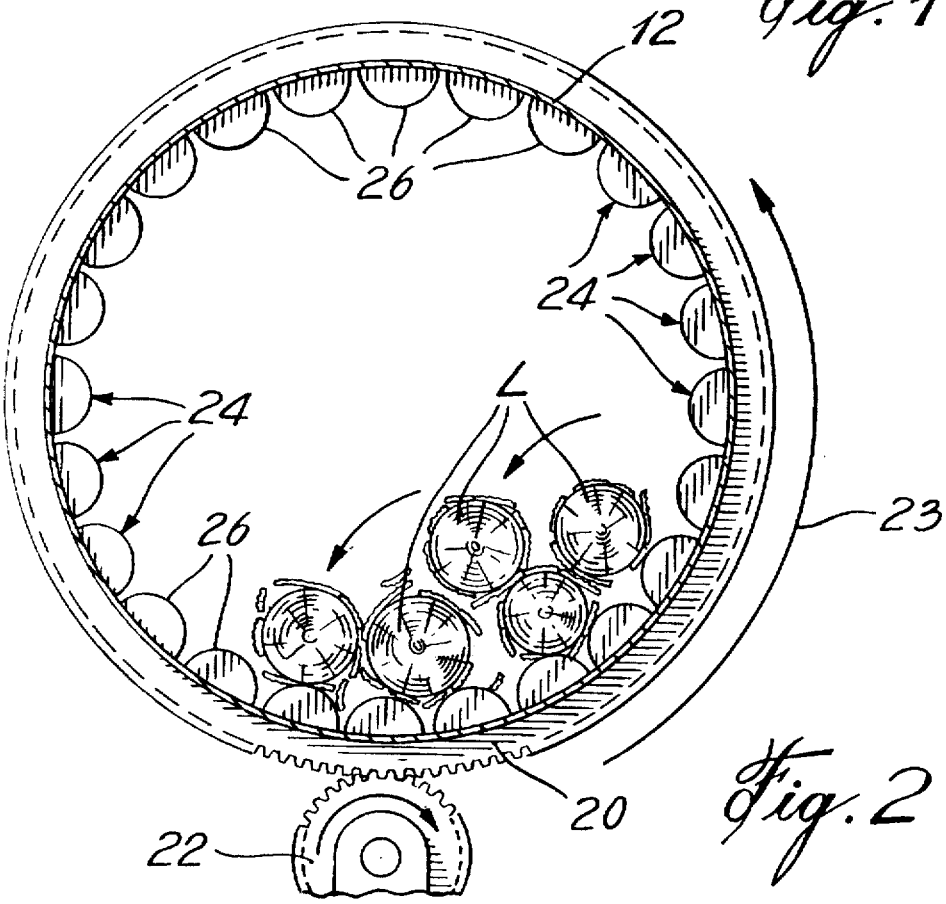
FIG. 2 is a cross-sectional view taken along lines 2—2 of FIG. 1 of the debarking drum.
Figure 3:
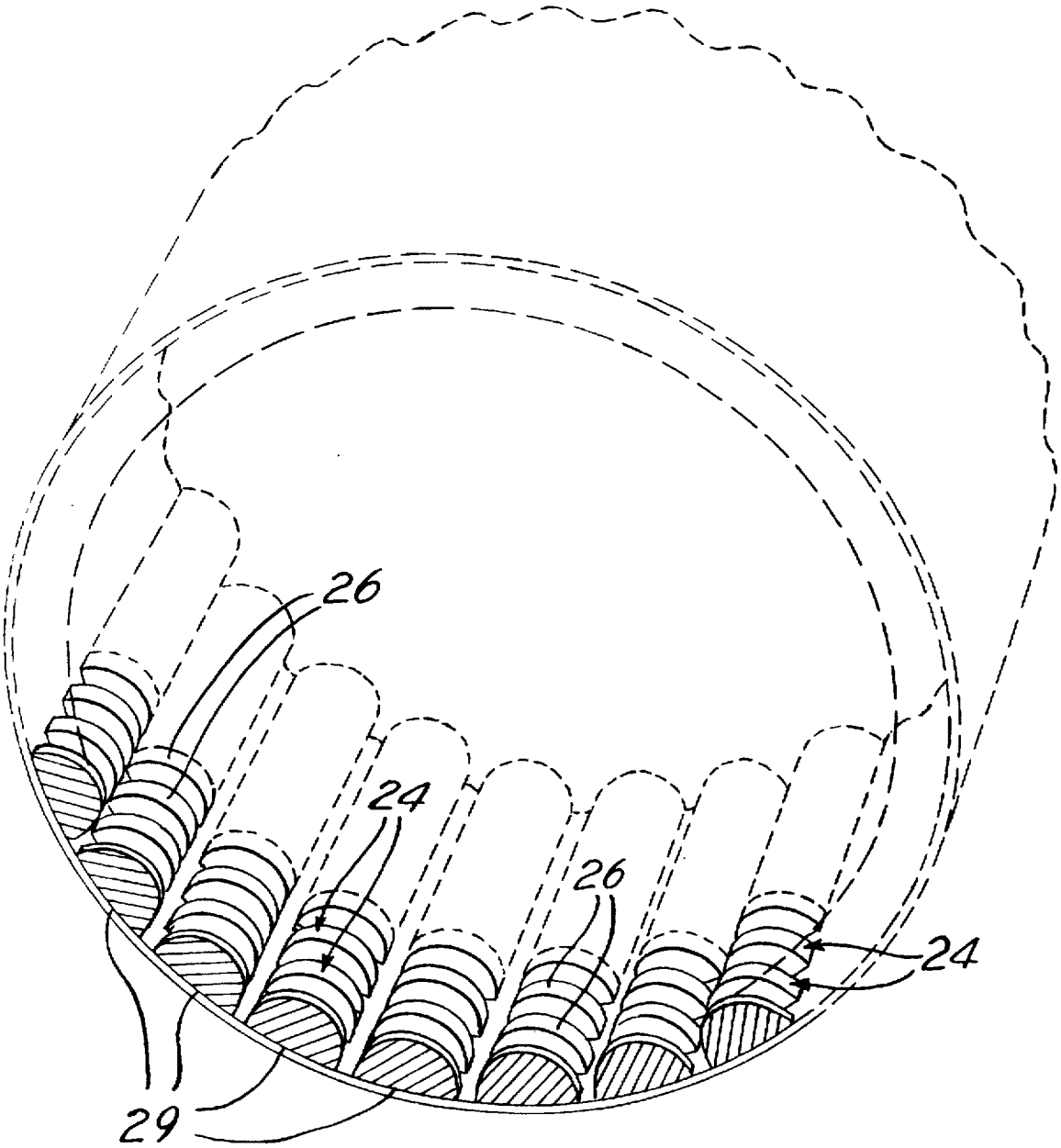
FIG. 3 is a perspective view of a plurality of longitudinally spaced-apart debarking tools arranged in rows on an inner circumference of a debarking drum shown in dotted lines, the dotted lines also suggesting further debarking tools.

As seen in FIGS. 2 and 3, the debarking drum 10 further includes a plurality of debarking ribs 24 disposed in axially extending rows on an inner circumference of the debarking drum 12. The rows are regularly and circumferentially spaced apart and typically extend on the entire length of the cylindrical member 12. According to a preferred embodiment of the present invention, a space of about ten inches separates each consecutive debarking ribs 24 of a same row. However, it is understood that depending on the size of the logs L to be debarked, this spacing may be greater or smaller. For conventional applications, the distance between two consecutive debarking ribs 24 of a same row should be in a range extending from 6 to 14 inches.

Figure 4:
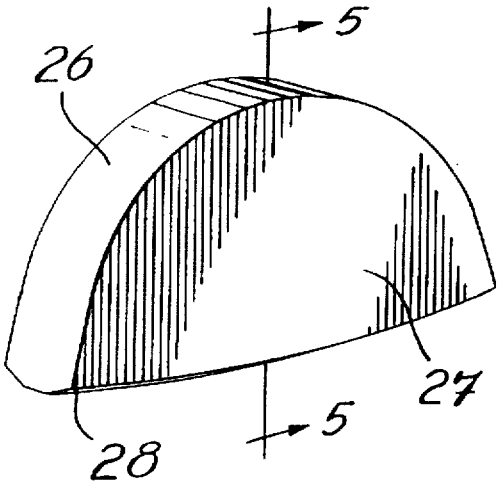
FIG. 4 is a perspective view of a debarking tool of FIG. 3.
Figure 5:
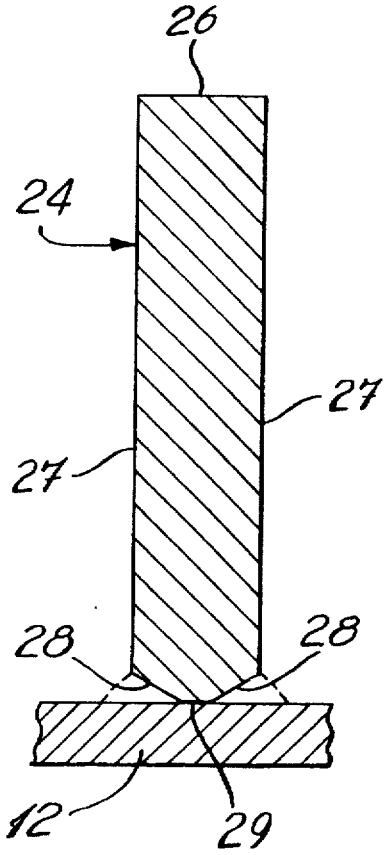
FIG. 5 is a cross-sectional view taken along the lines 5—5 of FIG. 4 of a debarking tool.

Each debarking rib 24 is provided with an arcuate working surface 26 and extends transversally relative to the longitudinal axis of the cylindrical member 12. Each debarking drum further includes a pair of parallel semi-circular side walls 27. As best seen in FIGS. 4 and 5, each debarking rib 24 is formed of a substantially flat semi-circular or slightly parabolic member which has bottom edges 28 which are bevelled to facilitate the welding thereof to the inner circumference of the cylindrical member 12. The underside 29 of each debarking ribs 24 is arcuate so as to follow the curvature of the inner periphery of the cylindrical member 12.

The cylindrical member 12 and the debarking ribs 24 are made of a rigid and strong metallic material, such as steel, which is capable of withstanding a considerable number of shocks and high stresses for a long period of time without structural failure.

In operation, the cylindrical member 12 is rotatably driven to cause the logs L loaded therein to tumble against each other and against the working surfaces 26 of the debarking ribs 24 so that the bark is knocked off, as shown in FIG. 2. It is noted that the logs L are maintained substantially parallel to the cylindrical member axis throughout the debarking operations. The above described debarking ribs arrangement contributes to increase the efficiency of the overall debarking operation.

Figure 6:
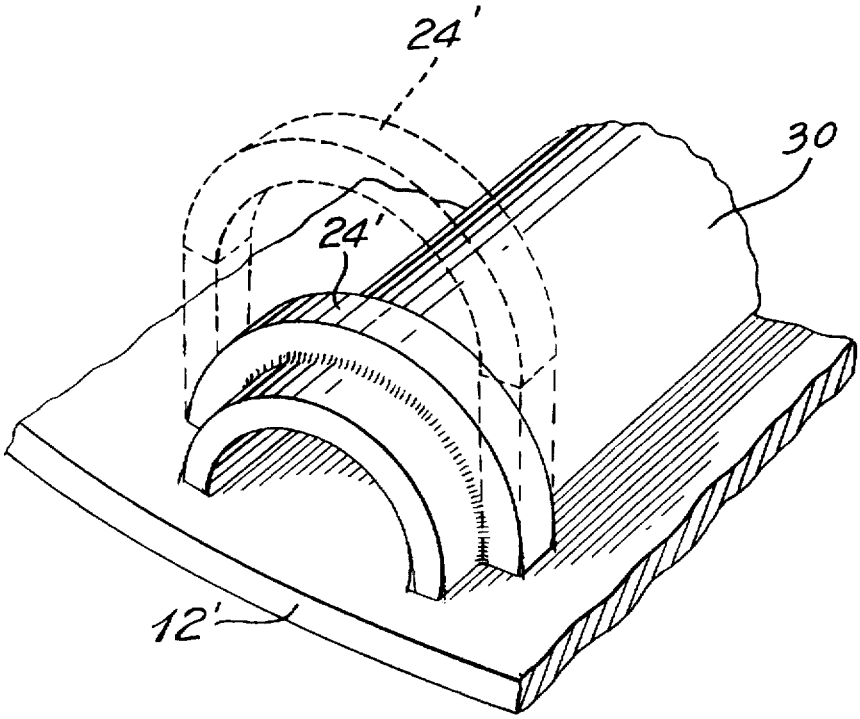
FIG. 6 is a fragmentary enlarged perspective view of an inner surface of a debarking drum according to a second preferred embodiment of the present invention illustrating how a U-shaped debarking member is installed to an existing longitudinally extending stave secured to an inner surface of the debarking drum.
Figure 7:
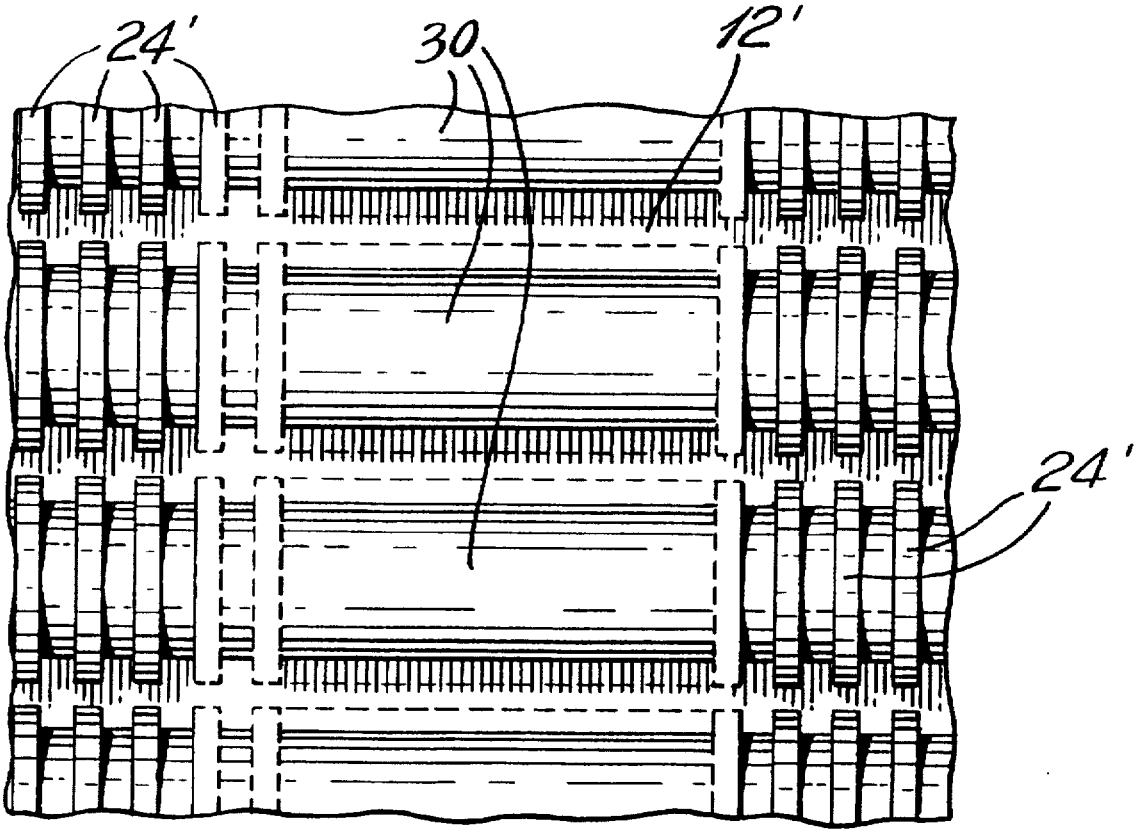
FIG. 7 is a fragmentary enlarged plan view of the inner surface of the debarking drum of FIG. 6, the dotted lines suggesting the installation of further U-shaped debarking members.

It is also in the scope of the present invention to retrofit the above in-line discontinuous debarking rib arrangement to an existing debarking drum 10' having continuous axially extending staves 30 circumferentially and regularly distributed around an inner periphery of a cylindrical member 12'. In this particular case, as shown in FIG. 6, each debarking ribs 24' is in the form of a substantially U-shaped member which is adapted to fit on an outer circumference of one of the staves 30. Once in position, the debarking ribs 24' are welded to the staves 30. Accordingly, as shown in FIG. 7, a plurality of debarking ribs 24' may be welded at regular intervals along the length of each stave 30 to form axially extending rows of debarking ribs around the inner circumference of the cylindrical member 12'.

I claim:

1. A rotatable debarking drum for removing the bark from logs comprising a generally cylindrical drum means having a longitudinal axis, and a plurality of axially extending rows of debarking means circumferentially distributed on an inner circumference of said cylindrical drum means, each said row of debarking means including a plurality of axially spaced-apart arcuate rib means extending transversally relative to said longitudinal axis of said cylindrical drum means.

2. A rotatable debarking drum as defined in claim 1, wherein the distance between two consecutive arcuate rib means of a same row is of about ten inches.

3. A rotatable debarking drum as defined in claim 1, wherein each said arcuate rib means includes two parallel semi-circular side walls and a top arcuate surface.

4. A rotatable debarking drum as defined in claim 3, wherein each said semi-circular member has bevelled bottom edges.

5. A rotatable debarking drum as defined in claim 3, wherein each said semi-circular member has an arcuate under surface which is conformed to arcuate segments of said cylindrical drum means inner circumference.

6. A rotatable debarking drum as defined in claim 1, wherein a plurality of longitudinally extending arcuate stave means are secured at separate locations to said inner circumference of said drum means, and wherein a plurality of spaced-apart rib means are mounted on each said arcuate stave means.

7. A rotatable debarking drum as defined in claim 6, wherein each said rib means includes a substantially U-shaped member which is configured to fit on an outer circumference of one of said stave means.

8. A rotatable debarking drum as defined in claim 7, wherein said U-shaped members are welded to said stave means.

9. A rotatable debarking drum as defined in claim 1, wherein each said row of debarking means extend throughout the length of said drum means.

10. A rotatable debarking drum as defined in claim 1, wherein each said arcuate rib means includes a top arcuate debarking surface.

* * * * *